US009951736B2

(12) United States Patent
Powell

(10) Patent No.: US 9,951,736 B2
(45) Date of Patent: Apr. 24, 2018

(54) FUEL INJECTOR TIP

(71) Applicant: DENSO International America, Inc., Southfield, MI (US)

(72) Inventor: Patrick Powell, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 56 days.

(21) Appl. No.: 15/085,405

(22) Filed: Mar. 30, 2016

(65) Prior Publication Data

US 2017/0284354 A1 Oct. 5, 2017

(51) Int. Cl.

| | |
|---|---|
| ***F02M 61/16*** | (2006.01) |
| ***F02M 61/18*** | (2006.01) |
| ***F02M 99/00*** | (2006.01) |
| ***F02M 27/02*** | (2006.01) |

(52) U.S. Cl.

CPC ..... *F02M 61/166* (2013.01); *F02M 27/02* (2013.01); *F02M 61/168* (2013.01); *F02M 61/184* (2013.01); *F02M 61/1813* (2013.01); *F02M 2200/9053* (2013.01); *F02M 2200/9061* (2013.01)

(58) Field of Classification Search

CPC ..... F02M 61/162; F02M 61/166; F02M 2200/9046; F02M 2200/9038; F02M 61/1806; F02M 61/168; F02M 61/1813; F02M 61/184; F02M 2200/9053; F02M 2200/9061

See application file for complete search history.

(56) References Cited

U.S. PATENT DOCUMENTS

| | | | | |
|---|---|---|---|---|
| 4,094,469 | A * | 6/1978 | Woringer | F02M 43/04 239/399 |
| 4,856,713 | A * | 8/1989 | Burnett | F02M 43/04 123/23 |
| 5,540,200 | A * | 7/1996 | Naitoh | F02M 51/065 123/299 |
| 5,775,289 | A * | 7/1998 | Yoshida | F01N 3/04 123/305 |
| 7,841,180 | B2 * | 11/2010 | Kraemer | F02C 7/22 60/39.822 |
| 8,215,572 | B2 * | 7/2012 | Vogel | F02B 23/0669 123/299 |
| 9,518,547 | B2 * | 12/2016 | John | F02M 61/14 |
| 2008/0173733 | A1 * | 7/2008 | Raab | F02M 61/166 239/533.2 |
| 2012/0305674 | A1 * | 12/2012 | Buehner | F02M 61/168 239/533.2 |
| 2012/0312900 | A1 * | 12/2012 | Hashii | F02M 51/0671 239/533.2 |
| 2014/0097275 | A1 * | 4/2014 | Wang | C23C 18/32 239/584 |

* cited by examiner

*Primary Examiner* — Darren W Gorman
(74) *Attorney, Agent, or Firm* — Harness, Dickey & Pierce, P.L.C.

(57) ABSTRACT

A fuel injector tip for a fuel injector. The fuel injector tip includes an inner tip surface and an outer tip surface that is opposite to the inner tip surface. At least one orifice extends through the fuel injector tip from the inner tip surface to the outer tip surface, and is configured to atomize fuel flowing therethrough to generate a fuel mist. The fuel injector tip is three-dimensionally printed.

16 Claims, 4 Drawing Sheets

FUEL INJECTOR TIP

FIELD

The present disclosure relates to a fuel injector tip for a combustion engine fuel injector, such as a three-dimensionally printed fuel injector tip.

BACKGROUND

This section provides background information related to the present disclosure, which is not necessarily prior art.

Fuel injectors have been used for many years with internal combustion engines to inject fuel into combustion chambers of the engines. While current fuel injectors are suitable for their intended use, they are subject to improvement. For example, it would be desirable to have a fuel injector tip with orifices that are more durable and configured to generate an atomized fuel mist or cloud that more evenly distributes fuel across a cylinder head, and provides a finer fuel mist as compared to existing fuel injector tips. The present teachings provide for improved fuel injectors that address these needs in the art, as well as numerous others

SUMMARY

This section provides a general summary of the disclosure, and is not a comprehensive disclosure of its full scope or all of its features.

The present teachings provide for a fuel injector tip for a fuel injector. The fuel injector tip includes an inner tip surface and an outer tip surface that is opposite to the inner tip surface. At least one orifice extends through the fuel injector tip from the inner tip surface to the outer tip surface, and is configured to atomize fuel flowing therethrough to generate a fuel mist. The fuel injector tip is three-dimensionally printed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
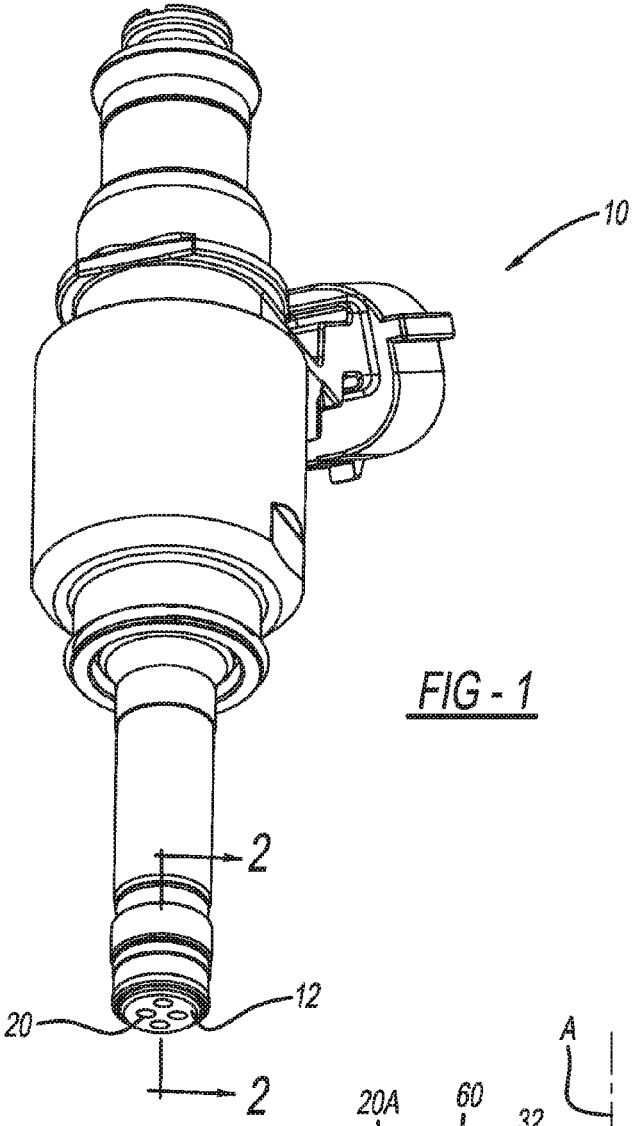
FIG. 1 is a perspective view of a fuel injector including a fuel injector tip in accordance with the present teachings.

FIG. 1 illustrates a fuel injector 10 including a nozzle tip 12 according to the present teachings. The tip 12 defines one or more orifices 20, through which the fuel injector injects fuel into a combustion chamber of any suitable internal combustion engine, such as, but not limited to an internal combustion engine of a vehicle. The internal combustion engine can be configured to propel any suitable vehicle, such as any suitable passenger vehicle, mass transit vehicle, recreational vehicle, military vehicle, aircraft, watercraft, etc. Although FIG. 1 illustrates the tip 12 as defining four orifices 20, the tip 12 may define any suitable number of orifices, such as, but not limited to, one, two, three, four, or more orifices 20.

The nozzle tip 12 is formed using any suitable three-dimensional manufacturing or printing process (also known as additive manufacturing), using any suitable three-dimensional manufacturing device. Any suitable type of three-dimensional manufacturing can be used, such as, but not limited to, the following: fused deposition modeling; fused filament fabrication; robocasting; stereo lithography; digital light processing; powder bed three-dimensional printing; inkjet head three-dimensional printing; electron-beam melting; selective laser melting; selective heat sintering; selective laser sintering; direct metal laser sintering; laminated object manufacturing; or electron beam freeform fabrication. Any of the tips 12 described herein can be manufactured using three-dimensional printing, or any other suitable manufacturing process.

Figure 2:
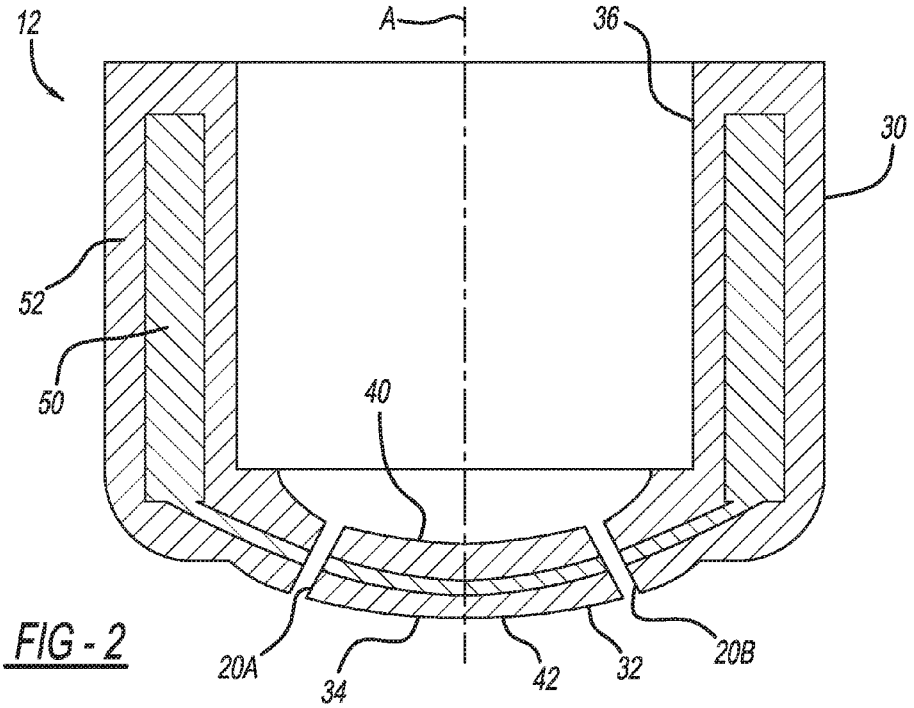
FIG. 2 is a cross-sectional view of the fuel injector tip taken along line 2-2 of FIG. 1.

With reference to FIG. 2, the tip 12 generally includes a body portion 30, and a head portion 32 at a distal end 34 of the tip 12. The body portion 30 and the head portion 32 generally define an internal cavity 36. Fuel is expelled out of the internal cavity 36 through the orifices 20, such as with a fuel injector plunger. At the head portion 32 is an inner tip surface 40, which is opposite to an outer tip surface 42. The cross-sectional view of FIG. 2 illustrates a first orifice 20A and a second orifice 20B, each of which extend through the head portion 32 from the inner tip surface 40 to the outer tip surface 42.

The tip 12 includes an inner core 50, which is surrounded by an outer shell 52. The inner core 50 extends from the body portion 30 to and across the head portion 32. The inner core 50 can include any suitable material having a high heat transfer coefficient, such as a heat transfer coefficient that is higher than a heat transfer coefficient of the outer shell 52. For example, the core 50 can include one or more of aluminum and copper, or any other suitable material with a high heat transfer coefficient. The outer shell 52 can include, for example, stainless steel or any other suitable material.

Providing the core 50 with a high heat transfer coefficient as compared to the outer shell 52 facilitates transfer of heat to the outer tip surface 42. Heat is also transferred to outer portions of the body portion 30 to direct heat away from the head portion 32, thereby advantageously cooling the tip 12 and particularly the head portion 32. Maintaining the tip 12 at a relatively cool temperature advantageously prevents buildup and deposits of unburned fuel and additives on the outer tip surface 42, as well as clogging of the orifices 20. Forming the tip 12 using three-dimensional printing advantageously permits forming the tip 12 as one monolithic structure, having both the core 50 and the outer shell 52, which include different materials.

The outer tip surface 42 can be treated to decrease the roughness thereof to 2 μm Ra, about 2 μm Ra, or less than 2 μm Ra. Providing the outer tip surface 42 with such a low roughness advantageously prevents materials, such as carbon, from entering micro-depressions at the outer tip surface 42, which can result in fouling of the outer tip surface 42. The outer tip surface 42 can be smoothened to provide such a roughness in any suitable manner, such as by using laser pulsing technology.

Figure 3:
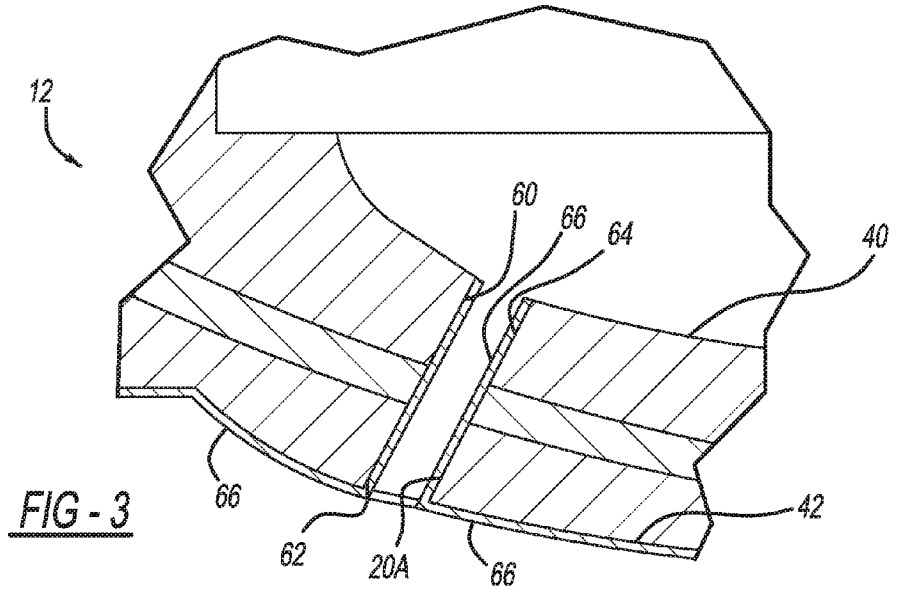
FIG. 3 is a cross-sectional view of an orifice of the fuel injector tip of FIG. 2 including a catalytic material in the orifice and proximate thereto.

With additional reference to FIG. 3, each one of the orifices 20 includes a proximal end 60 at the inner tip surface 40, and a distal end 62 at the outer tip surface 42. An inner orifice surface 64 extends between the proximal end 60 and the distal end 62. FIG. 3 illustrates an exemplary first orifice 20A including a catalyst 66 deposited on the outer tip surface 42. The catalyst 66 can extend across any suitable portion of the outer tip surface 42. The catalyst 66 may also extend into the inner orifice surface 64, such as to the proximal end 60 as illustrated in FIG. 3. The catalyst 66 may be any suitable catalyst configured to facilitate fuel burn, thereby preventing fouling on the outer tip surface 42. The catalyst 66 may be provided on the outer tip surface 42 and/or along the inner orifice surface 64 in any suitable manner, such as with three-dimensional printing during printing of the tip 12, by vapor deposition, or in any other suitable manner. Although FIG. 3 illustrates the catalyst 66 as proximate to, and extending into, the first orifice 20A, the catalyst 66 can be provided across the outer tip surface 42 to and around, as well as into, any of the other orifices 20 of the tip 12.

Figure 4:
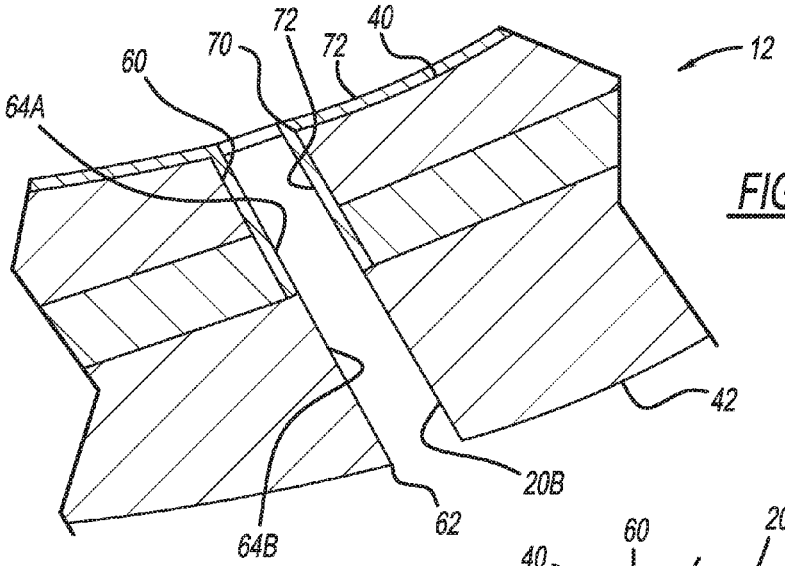
FIG. 4 is a cross-sectional view of another orifice of the fuel injector tip of FIG. 2, inner corners of the orifice are hardened and/or include a metallic material to improve durability and long-term calibration stability.

FIG. 4 illustrates the second orifice 20B. At the proximal end 60, the second orifice 20B has a proximal edge or corner 70 where the second orifice 20B transitions to the inner tip surface 40. This proximal edge 70 of the orifice 20B, as well as the proximal edge 70 of any of the other orifices 20, can itself be hardened and/or be covered with a protective material 72 (such as a protective metal) of sufficient hardness in order to improve durability of the tip 12, and improve long-term calibration stability of the fuel spray out through the orifices 20. The proximal edge/corner 70 can be hardened in any suitable manner, such as by forming the proximal edge/corner 70 during three-dimensional printing with a material, such as a metal, that is relatively harder than the adjacent portions of the tip 12. Alternatively or additionally, the protective material 72 of increased hardness can be printed over the proximal edge/corner 70, as well as optionally across the portion of the inner tip surface 40 near the edge/corner 70, during three-dimensional printing of the tip 12. Any suitable material having relatively increased hardness compared to the outer shell 52 can be used, such as tungsten or any other material having a hardness similar to that of tungsten. The hardened portion and/or protective material 72 can optionally extend any suitable distance into the second orifice 20B, or any of the other orifices 20, such as across a proximal inner orifice 64A as illustrated. A distal inner orifice surface 64B, which extends from the proximal inner orifice surface 64A to the distal end 62, may include or not include the hardened portion or protective material 72. The proximal edge/corner 70 of any of the other orifices 20 may be hardened as well.

Figure 5:
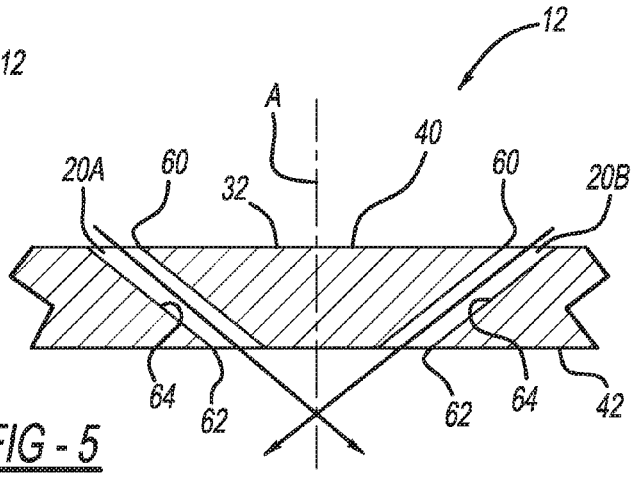
FIG. 5 is a cross-sectional view of another fuel injector tip according to the present teachings including two orifices angled towards one another and towards a longitudinal axis of the fuel injector tip.

With reference to FIG. 5, any of the orifices 20, such as the first orifice 20A and the second orifice 20B as illustrated in FIG. 5, can be angled so that they extend towards one another, and towards a longitudinal axis A of the tip 12, which also extends generally through an axial center of the head portion 32. For example and as illustrated in FIG. 5, the inner orifice surface 64 of each one of the first and second orifices 20A and 20B is angled from the proximal orifice end 60 to the distal orifice end 62 towards one another and towards the longitudinal axis A. Any one or more of the other orifices 20 may be angled towards the longitudinal axis A in a similar manner. As a result, fuel passing through the angled orifices 20, such as the angled first and second orifices 20A and 20B illustrated in FIG. 5, will intersect at an area distal to the head portion 32, which advantageously slows fuel penetration momentum and reduces wall wetting, which increases total fuel burn and improves fuel economy.

Figure 6:
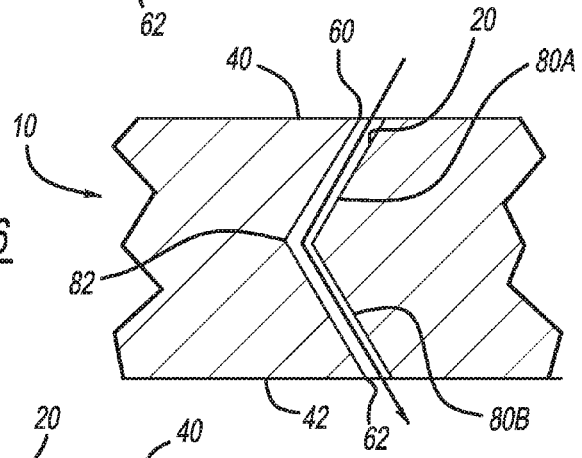
FIG. 6 is a cross-sectional view of another fuel injector tip according to the present teachings including an orifice having a first portion and a second portion that extend at different angles.

With reference to FIG. 6, any one of the orifices 20 can be angled along its length such that the inner orifice surface 64 changes direction between the proximal and distal orifice ends 60 and 62. Thus any one of the orifices 20 can include a first angled portion 80A extending from the inner tip surface 40 towards the outer tip surface 42, as illustrated in FIG. 6. Prior to reaching the outer tip surface 42, the first angled portion 80A transitions to a second angled portion 80B. The second angled portion 80B extends from the first angled portion 80A to the outer tip surface 42, and to the distal orifice end 62. The orifice 20 changes direction where the first angled portion 80A meets the second angled portion 80B, which occurs at turbulence point 82. As fuel flows from the first angled portion 80A to the second angled portion 80B, turbulence in the fuel is induced at the turbulence point 82, which advantageously results in an increase in fuel atomization, thereby generating a finer fuel mist and improving combustion. The turbulence point also advantageously increases fuel pressure, such as to 50-300 mPa. The first angled portion 80A can be angled away from the longitudinal axis A, and the second angled portion 80B can be angled towards the longitudinal axis A relative to the direction of fuel flow, or vice versa.

Figure 7:
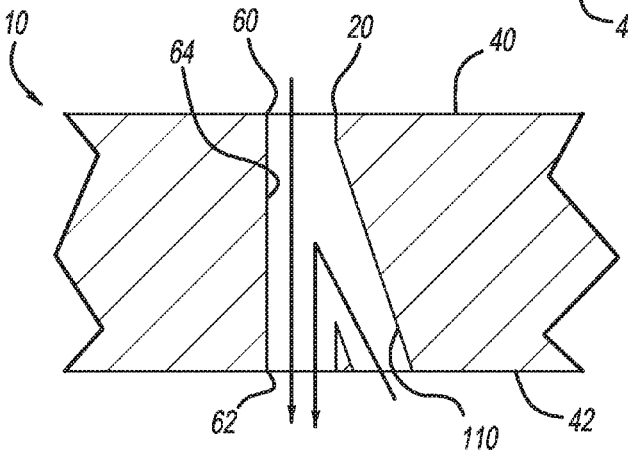
FIG. 7 is a cross-sectional view of another fuel injector tip according to the present teachings including an orifice with a mixing path associated therewith.

With reference to FIG. 7, any one of the orifices 20 can include a mixing path, such as a venturi mixing path 110. The venturi mixing path 110 extends to the orifice 20 from a point along the outer tip surface 42 spaced apart from the distal orifice end 62. The venturi mixing path 110 extends at an angle and intersects the orifice 20 along the length of the orifice 20 between the proximal orifice end 60 and the distal orifice end 62. The venturi mixing path 110 entrains hot gasses, such as air, into fuel flowing through the orifice 20. Adding air to the fuel stream flowing through the orifice 20 advantageously improves air/fuel mixing, thereby enhancing combustion efficiency. Any one or more of the orifices 20 included with the tip 12 can include the venturi mixing path 110. The venturi mixing path 110 can intersect the orifice 20 at any suitable angle, which is generally less than 90 degrees.

Figure 8:
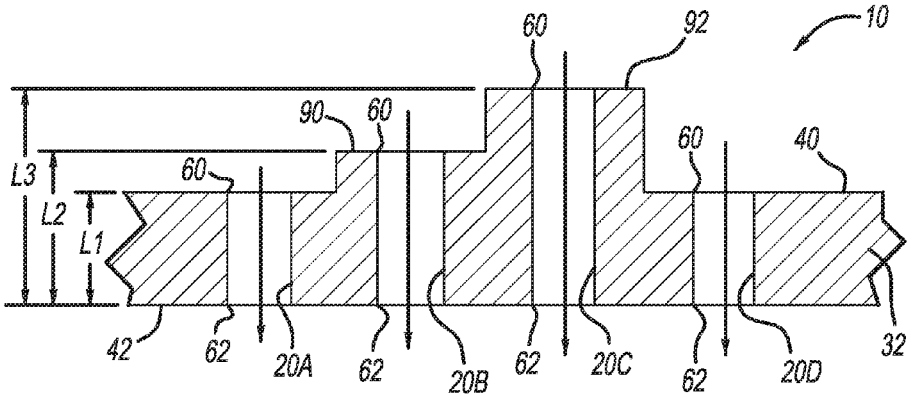
FIG. 8 is a cross-sectional view of another fuel injector tip according to the present teachings including a plurality of orifices of different lengths.

With reference to FIG. 8, the orifices 20 of the tip 12 can vary in length. For example, the tip 12 can have a first orifice 20A having a first length $L_1$ between the proximal orifice end 60 and the distal orifice end 62. The second orifice 20A can have a second length $L_2$ extending between the proximal orifice end 60 and the distal orifice end 62. The second length $L_2$ is greater than the first length $L_1$. The head portion 32 includes a first stepped portion 90 at the proximal orifice end 60 of the second orifice 20B in order to provide the second orifice 20B with additional length as compared to the first orifice 20A. The third orifice 20C can have a third length $L_3$, which is greater than the second length $L_2$. To provide the third orifice 20C with the additional length, the head portion 32 includes a second stepped portion 92 at the proximal orifice end 60. The fourth orifice 20D can have the length $L_1$, or any other suitable length, such as the length $L_2$, the length $L_3$, a length greater than $L_3$, or a length less than $L_1$. The tip 12 can include additional orifices 20 having any suitable length, and can include less than all of the orifices 20A-20D. The lengths $L_1$, $L_2$, and $L_3$ are merely exemplary lengths, and thus any one of the orifices 20A-20D can have any other suitable length.

Each one of the orifice lengths $L_1$, $L_2$, and $L_3$, as well as any other suitable length, has a different effect on the spray or atomization pattern of fuel flowing out of the orifices 20. Therefore, the pattern of fuel spray can be modified and customized by varying the lengths L of the orifices 20 in order to modify or "tune" the pattern of the fuel spray to best suit the engine. In addition to controlling the pattern of the fuel spray, penetration of fuel into the engine combustion chamber can be modified and controlled as well. In order to accommodate orifices 20 having different lengths L, the fuel injector 10 can include a plunger having a head with one or more offset surfaces configured to accommodate stepped portions of the head portion 32, such as the first and second stepped portions 90 and 92.

Figure 9:
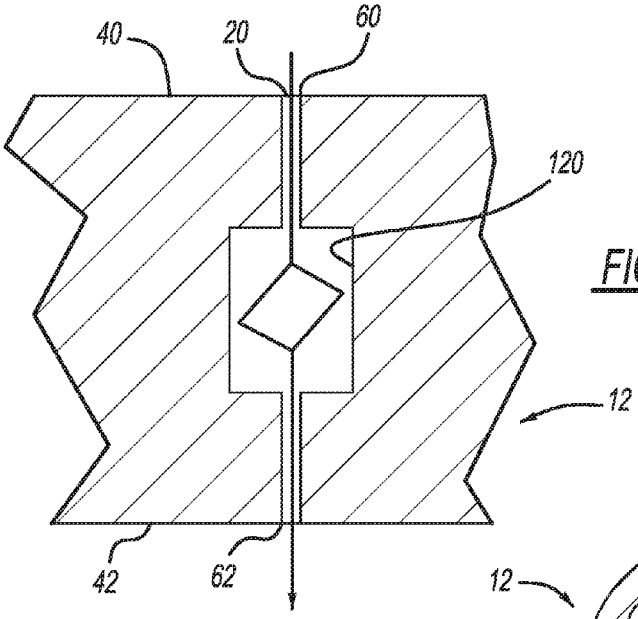
FIG. 9 is a cross-sectional view of another fuel injector tip according to the present teachings including an orifice with an expansion chamber along a length of the orifice.

With reference to FIG. 9, any one of the orifices 20 can include an expansion chamber 120 along the length thereof. The expansion chamber 120 can be provided at any suitable position between the proximal end 60 and the distal end 62 of the orifices 20. The expansion chamber 120 is generally a portion of the orifice 20 that has a larger internal surface area as compared to the portions of the orifice 20 on opposite sides of the expansion chamber 120. The expansion chamber 120 induces turbulence in the fuel as fuel flows through the expansion chamber 120 thereby advantageously increasing atomization of the fuel mist generated as fuel flows out of any of the orifices 20 including the expansion chamber 120. The expansion chamber 120 also advantageously increases injection pressures, such as to about 50 to 300 mPa.

Figure 10:
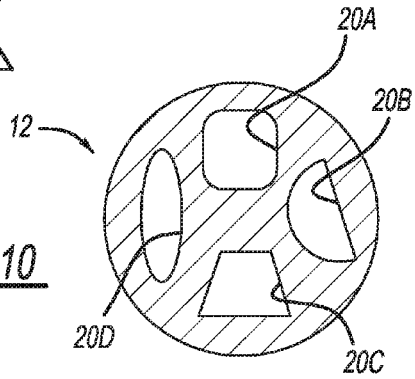
FIG. 10 is a cross-sectional view of another fuel injector tip according to the present teachings including a plurality of orifices having different cross-sectional shapes.

With reference to FIG. 10, the tip 12 can include orifices 20 having any suitable cross-sectional shape in addition to a generally circular shape. For example and as illustrated in FIG. 10, first orifice 20A and/or any of the other orifices 20, can have a generally square cross-section. Second orifice 20B, and/or any of the other orifices 20, can have a cross-section that includes a planar surface with a curved surface extending therefrom. In other words, the second orifice 20B can be shaped as a half-circle in cross-section. The third orifice 20C, and/or any of the other orifices 20, can have a generally trapezoidal shape. The fourth orifice 20D, and/or any of the other orifices 20, can have a generally oval cross-section. The orifices 20 can have any other suitable cross-sectional shape as well. For example, the orifices 20 can also include bumps and/or other protrusions along their lengths in order to disrupt the fuel flow pattern as it flows through the orifices 20.

Forming the tip 12 with three-dimensional printing advantageously allows for forming the orifices 20 with any suitable cross-sectional shape. The different shapes have different effects on the spray pattern of fuel flowing through the orifices 20. Therefore, the fuel flow pattern through the orifices 20 and the fuel mist generated as fuel flows out of the orifices 20 can be customized (or "tuned") in order to provide fuel mist best suited to the particular engine that the fuel injector 10 and the tip 12 thereof is intended for use with.

The present teachings thus provide for improved fuel injector tips 12 formed by three-dimensional printing, which are configured to generate a finer fuel mist that is more evenly distributed in the engine combustion chamber across the engine cylinder head to facilitate fuel burn and combustion in the combustion chamber. This provides numerous advantages, including enhanced engine performance and improved fuel economy.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used is for the purpose of describing particular example embodiments only and is not intended to be limiting. The singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fuel injector tip for a fuel injector, the fuel injector tip comprising:

a first material;

a second material surrounded by the first material, the second material has a higher heat transfer coefficient as compared to the first material and is configured to reduce the fuel injector tip's operating temperature;

an inner tip surface;

an outer tip surface opposite to the inner tip surface;

a first portion of the first material is at the inner tip surface and a second portion of the first material is at the outer tip surface, the second material is sandwiched between the first portion of the first material and the second portion of the first material; and at least one orifice extending through the fuel injector tip from the inner tip surface to the outer tip surface, and configured to atomize fuel flowing therethrough to generate a fuel mist;

wherein the at least one orifice extends through the first portion of the first material, the second material, and the second portion of the first material;

wherein each one of the first portion of the first material, the second portion of the first material, and the second material is exposed at an interior of the at least one orifice; and wherein the fuel injector tip is three-dimensionally printed.

2. The fuel injector tip of claim 1, wherein:

the first material includes stainless steel; and the second material includes at least one of aluminum and copper.

3. The fuel injector tip of claim 1, wherein the outer tip surface has a surface roughness of 2 μm Ra or less.

4. The fuel injector tip of claim 1, wherein an inner edge of the at least one orifice includes a metallic material.

5. The fuel injector tip of claim 4, wherein the metallic material includes tungsten.

6. The fuel injector tip of claim 1, wherein the outer tip surface includes a catalytic material.

7. The fuel injector tip of claim 6, wherein the catalytic material includes platinum that is vapor deposited on the catalytic material.

8. The fuel injector tip of claim 1, wherein the at least one orifice includes a first orifice and a second orifice angled towards one another such that a first fuel spray exiting the first orifice and a second fuel spray exiting the second orifice intersect.

9. The fuel injector tip of claim 1, further comprising a venturi mixing path intersecting the at least one orifice configured to direct at least one of air or gas to fuel flowing through the at least one orifice for mixing with the fuel.

10. The fuel injector tip of claim 9, wherein the venturi mixing path extends to the at least one orifice from the outer tip surface.

11. The fuel injector tip of claim 1, wherein the at least one orifice includes a plurality of orifices having different lengths.

12. The fuel injector tip of claim 1, wherein the at least one orifice includes a first angled portion extending at a first angle, and a second angled portion extending at a second angle that is different than the first angle.

13. The fuel injector tip of claim 1, further comprising an expansion chamber along a length of the at least one orifice, the expansion chamber configured to induce turbulence in fuel flowing therethrough, thereby providing fuel exiting the fuel injector tip with increased atomization and an increased fuel mist.

14. The fuel injector tip of claim 1, wherein the at least one orifice is non-circular in cross-section.

15. The fuel injector tip of claim 1, wherein the at least one orifice includes a plurality of orifices each shaped differently in cross-section.

16. The fuel injector tip of claim 1, wherein the at least one orifice has a cross-sectional shape that is oval, square, or trapezoidal.

* * * * *